US008187023B1

(12) United States Patent
Chen

(10) Patent No.: US 8,187,023 B1
(45) Date of Patent: May 29, 2012

(54) WIRE CONNECTOR WITH TWO SPRING PLATES

(75) Inventor: Yong-Chou Chen, Taichung (TW)

(73) Assignee: Uta Auto Industrial Co., Ltd., Taichung (TW)

( * ) Notice: Subject to any disclaimer, the term of this patent is extended or adjusted under 35 U.S.C. 154(b) by 0 days.

(21) Appl. No.: 13/107,398

(22) Filed: May 13, 2011

(51) Int. Cl.
*H01R 4/24* (2006.01)

(52) U.S. Cl. ..... 439/441; 439/439

(58) Field of Classification Search ..... 439/436, 439/441, 439
See application file for complete search history.

(56) References Cited

U.S. PATENT DOCUMENTS

| | | | | |
|---|---|---|---|---|
| 4,824,395 | A | 4/1989 | Blaha et al. | |
| 4,978,315 | A * | 12/1990 | Edgley et al. | 439/441 |
| 5,454,730 | A * | 10/1995 | Tozuka | 439/438 |
| 5,975,940 | A * | 11/1999 | Hartmann et al. | 439/441 |
| 6,746,286 | B2 * | 6/2004 | Blaha | 439/787 |
| 6,981,890 | B2 * | 1/2006 | Cutler et al. | 439/441 |
| 7,976,330 | B2 * | 7/2011 | Lin | 439/353 |

FOREIGN PATENT DOCUMENTS

| | | | |
|---|---|---|---|
| CN | 2731750 | Y | 10/2005 |
| CN | 101060207 | A | 10/2007 |

OTHER PUBLICATIONS

English Abstract of CN 2731750.
English Abstract of CN 101060207.

* cited by examiner

*Primary Examiner* — Hien Vu
(74) *Attorney, Agent, or Firm* — Wang Law Firm, Inc.; Li K. Wang

(57) ABSTRACT

A wire connector with two spring plate parts comprises a box, a spring plate, a fixing base, and a conductive plate. The spring plate is integrally formed and fixed inside the box. The spring plate has first plate parts on its first extension part and second plate parts on its second extension part. The exposed end of a wire is inserted via the holes of the fixing base and held by the first plate parts and the second plate parts. The exposed end of the wire is thus in electrical contact with the conductive plate on the bottom part.

3 Claims, 4 Drawing Sheets

WIRE CONNECTOR WITH TWO SPRING PLATES

BACKGROUND OF THE INVENTION

1. Field of Invention

The invention relates to a wire connector with two spring plate parts and, in particular, to a device for the insertion of a wire to electrically connect with a conductive plate inside the connector.

2. Related Art

PROC Pat. No. 200710109779.0 discloses an electronic wire connector, consisting mainly of a connector box, a box cover, an elastic steel plate, and a serial bus. When a wire is inserted into the wire opening of the box cover, the spring plate peels off the insulating layer at the end and urges it against the serial bus, establishing an electrical connection. However, the exposed end of the wire is pinched by only a single plate. If the end of the wire is thinner, the holding force of the plate is insufficient. In this case, the exposed end of the wire cannot be held tightly, and the wire may become loose. Besides, the manufacturing processes of the elastic steel plate and the serial bus are complicated, lowering the fabrication efficiency. U.S. Pat. No. 4,824,395 also discloses a wire connector. Although it is slightly different from PROC Pat No. 200710109779.0, the structure also uses a single plate to hold the exposed end of wire. The holding force is insufficient either. The wire is likely to fall off as well.

PROC Pat. No. 200420118550.5 discloses a wire connector consisting mainly of a fixing base, an outer cover, double spring plates, and a wire plate. A wire is inserted into the wire hole on the fixing base, and held by the double spring plates. The wire and the wire plate are thus in electrical contact. Although the inserted wire is held by the double spring plates in the fixing base, the structure of the double spring plates are in a V shape. Therefore, the double spring plates have to be manufactured by stacking two plates first. Its design and manufacturing costs are higher.

It is the purpose of the invention to solve the problems in the prior art.

SUMMARY OF THE INVENTION

An objective of the invention is to provide a wire connector with two spring plate parts, whose first plate part and second plate part are integrally formed with the spring plates. The design and manufacturing costs are lower. The exposed end of the inserted wire is held tightly by the two plate parts, one in the front and the other in the back. The exposed end of wire is therefore in firm electrical connection with a conductive plate.

To achieve the above-mentioned objective, the invention includes: a box, a spring plate, and a fixing base.

The box has an accommodating space inside. Its one end has an opening. A bottom wall and a top wall are under and above the accommodating space, respectively.

The spring plate is disposed into the accommodating space of the box via the opening. The spring plate is integrally formed, consisting of a bottom part, a first extension part, a connecting part, and a second extension part. The bottom part is attached to the bottom wall inside the box, with a conductive plate disposed thereon. The first extension part extends from the bottom part toward the opening. The first extension part has several longitudinal grooves to form at least two first plate parts. The connecting part extends from the top end of the first extension part toward the bottom part and parallel to the bottom part. The second extension is above the bottom part, and extends from the connecting part downward away from the opening, striding over the bottom part. The second extension part is cut to form a second plate part corresponding to each of the first plate parts. The bottoms of the first and second plate parts have roughly the same height of gap with the bottom part.

The fixing base is inserted into the accommodating space behind the spring plate and seals the opening. The fixing base has two through holes for wires, each of the holes corresponding to a first plate part of the first extension part and a second plate of the second extension part. The exposed end of wire is held tightly by the first plate part and the second plate part, thus in electrical contact with the conductive plate. The fixing base has a slant surface respectively around each of the holes on one end inside the box. Each of the slant surfaces urges against the first plate parts on the back of the first extension part. The connecting part of the spring plate thus urges against the top wall inside the box.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
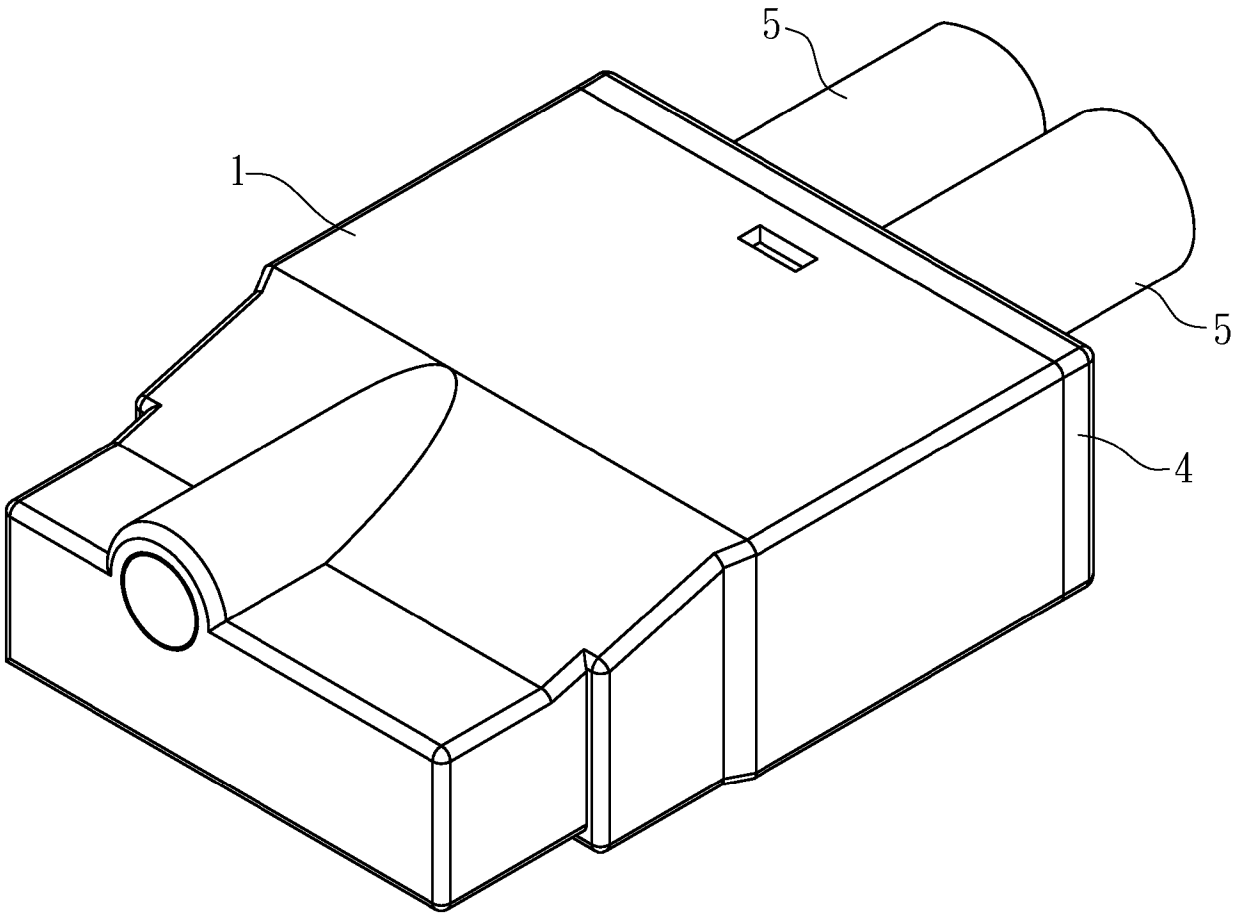
FIG. 1 is a three-dimensional perspective view of the invention.
Figure 2:
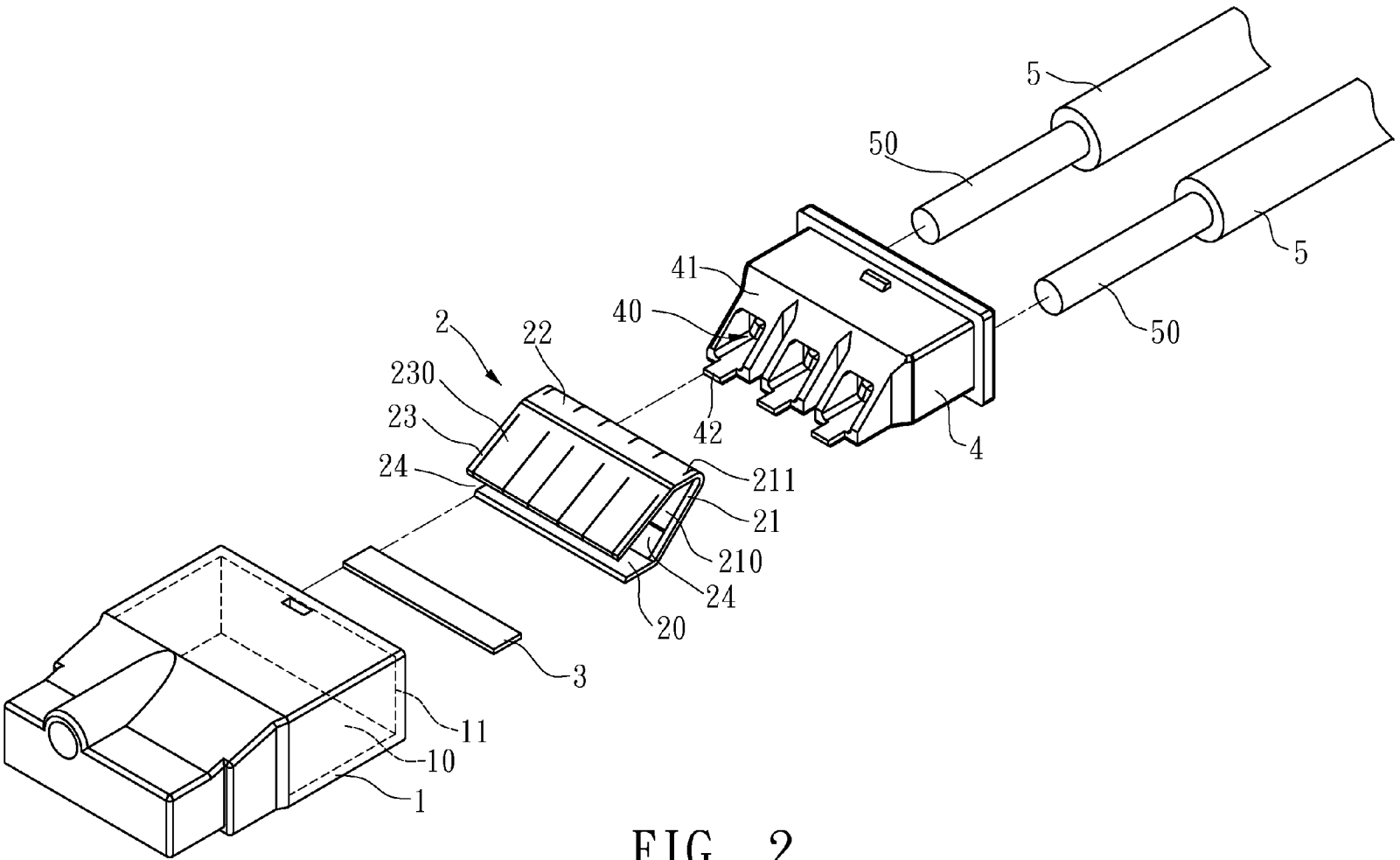
FIG. 2 is a three-dimensional exploded view of the invention.

An embodiment of the wire connector with two spring plate parts according to the invention is shown in FIGS. 1 and 2. The embodiment includes a box 1, a spring plate 2, a conductive plate 3, and a fixing base 4, for the insertion of a wire 5.

As shown in the drawings, the box 1 has an accommodating space 10 inside. One end thereof has an opening 11. A bottom wall 12 and a top wall 13 are under and above the accommodating space 10, respectively. There is a first blocking part 14 inside the end of the box 11 away from the opening 11. A second blocking part 15 is above the first blocking part 14.

Figure 3:
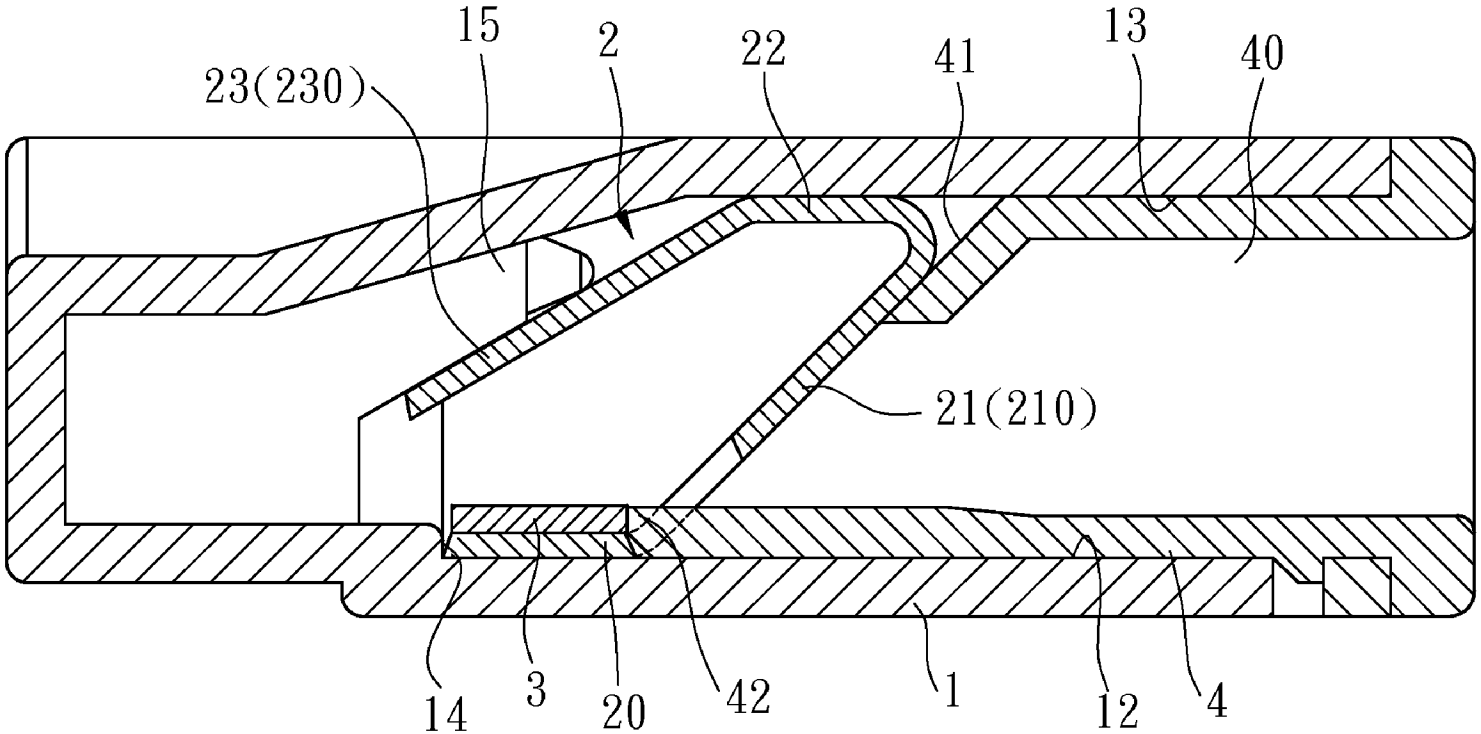
FIG. 3 is a cross-sectional view of the invention.

As shown in FIGS. 2 and 3, the spring plate 2 is inserted into the accommodating space 10 of the box 1 via the opening 11. The spring plate 2 is integrally formed with a bottom part 20, a first extension part 21, a connecting part 22, and a second extension part 23. The bottom part 20 is attached to the bottom wall 12 inside the box 1. The conductive plate 3 is disposed on the bottom part 20. The first extension part 21 extends from the bottom part 20 toward the opening 11. The first extension part 21 has a plurality of longitudinal grooves 211 to form three first plate parts 210. The connecting part 22 extends from the top of the first extension part 21 toward the bottom part 20 and parallel to the bottom part 20. The second extension part 23 is above the bottom part 20, and extends from the connecting part 22 downward away from the opening 11 and strides across the bottom part 20. The second extension part 23 is cut with a second plate part 230 corresponding to each of the first plate parts 210. The first plate parts 210 and the second plate parts 230 have roughly same height of gap 24 between their bottoms and the bottom part 20. In this embodiment, each of the longitudinal grooves 211 of the first extension part 21 is bent and extended upward to the connecting part 22.

As shown in FIGS. 1 to 3, the fixing base 4 is inserted behind the spring plate 2 into the accommodating space 10 and seals the opening 11. The fixing base 4 has three through holes 40, each of which corresponds to one of the first plate parts 210 of the first extension part 21 and one of the second plate parts 230 of the second extension part 23. The fixing base 4 has a slant surface 41 around each of the holes 40 inside the box 1. In this embodiment, the fixing base 4 has an urging part 42 inside the box 1 under each of the holes 40 toward the bottom part 20 of the spring plate 2.

As shown in FIG. 3, the positioning of the spring plate 2 in the box 1 is achieved by the first blocking part 14 at the front edge of the bottom part. The second blocking part 15 of the box 1 blocks the second extension part 23 between any two of the second plate parts 230. The fixing base 4 uses the slant surfaces 41 to urge around the first plate parts 210 on the back surface 211 of the first extension part 21, so that the connecting part 22 of the spring plate 2 urges against the top wall 13 inside the box 1. The bottom part 20 of the spring plate 2 is urged by the urging parts 42 on the extended end of the first extension part 21. This ensures that the spring plate 2 is firmly positioned in the box 1.

Figure 4:
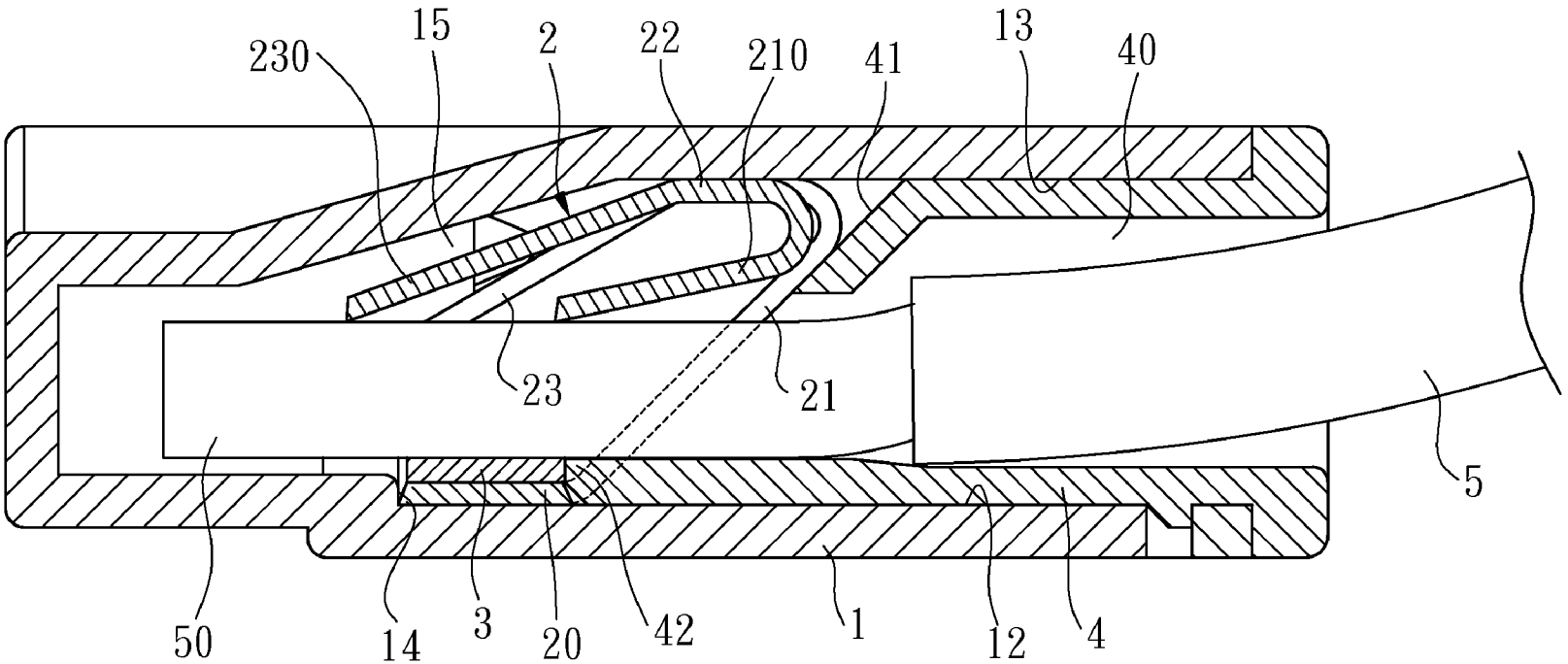
FIG. 4 is a schematic view showing the electrical connection between the inserted wire and the conductive plate.

Please refer to FIG. 4. To use the disclosed wire connector, one inserts a wire 5 of the right pole into the hole 40 of the fixing base 4. The exposed end 50 of the wire 5 is inserted along the gap 24 at the bottom of the first plate part 210 and the second plate part 230. The first plate part 210 and the second plate part 230 are thus pushed open. Once positioned, the exposed end 50 and the conductive plate 3 have an electrical contact. The first plate part 210 and the second plate part 230 then exert a downward pressing force on the exposed end 50. Thus, the exposed end 50 is tightly held by the first plate part 210 and the second plate part 230. The ends of the first plate part 210 and the second plate part 230 are slightly in touch with the exposed end 50 of the wire 5 (or the insulating layer covering the exposed end). The exposed end 50 of the wire is in electrical connection with the conductive plate 3 firmly inside the box 1.

It is easy to discover that the invention has the following advantages:

1. The disclosed wire connector uses an integrally formed spring plate 2 to hold tightly the wire 5. The holding is achieved using the first plate part 210 and the second plate part 230. The exposed end 50 of the wire 5 is thus in electrical connection with the conductive plate 3 in the box 1.

2. The spring plate 2 is integrally formed with the first plate part 210 and the second plate part 230. Therefore, the structure is simpler than conventional spring plates. The design and manufacturing are easier, lowering the costs.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A wire connector with two spring plate parts, comprising:

a box having an accommodating space inside, an opening on one end, a bottom wall under the accommodating space, and a top wall above the accommodating space;

a spring plate inserted into the accommodating space of the box via the opening and integrally formed with a bottom part, a first extension part, a second extension part, and a connecting part connecting the first extension part to the second extension part; wherein the bottom part is attached to the bottom wall inside the box, with a conductive plate disposed thereon, the first extension part extends from the bottom part toward the opening and has a plurality of longitudinal grooves to form at least two first plate parts, the connecting part extends from the top of the first extension part toward the bottom part and parallel to the bottom part, the second extension is over the bottom part from the connecting part downward away from the opening to stride across the bottom part, the second extension part is cut to form second plate parts for each of the first plate parts corresponding to each of the second plate parts, and the bottoms of the first plate parts and the second plates parts have roughly same height of gap with the bottom part; and a fixing base inserted behind the spring plate into the accommodating space and sealing the opening; wherein the fixing base has at least two through holes for the insertion of wires, each of the holes corresponding to one of the first plate parts of the first extension part and one of the second plate parts of the second extension part, the exposed end of the wire is tightly held by the corresponding first plate part and second plate part to have an electrical contact with the conductive plate, the fixing base has a slant surface around each of the through hole inside the box to urge around the corresponding first plate part from the back of the first extension part, thereby further pressing the connecting part of the spring plate against the top wall of the box, wherein an urging part extends from each of the holes on the end of the fixing base inside the box toward the bottom part of the spring plate, and the end of the bottom part of the spring plate extended with the first extension part is urged by the urging parts.

2. The wire connector with two spring plate parts of claim 1, wherein the box has a first blocking part to block the front end of the bottom part on the end away from the opening and at least one second blocking part that blocks the second extension part between at least two of the second plate parts.

3. The wire connector with two spring plate parts of claim 1 or 2, wherein each of the longitudinal grooves of the first extension part is bent upward and extended to the connecting part.

* * * * *